United States Patent [19]

Takahashi et al.

[11] Patent Number: 4,627,706

[45] Date of Patent: Dec. 9, 1986

[54] SORTING MACHINE AND IMAGE REPRODUCING APPARATUS

[75] Inventors: Seiji Takahashi; Masayuki Miyazaki; Tsugio Hirabayashi; Yoshikazu Maekawa, all of Hachioji, Japan

[73] Assignee: Konishiroku Photo Industry Co., Ltd., Tokyo, Japan

[21] Appl. No.: 719,358

[22] Filed: Apr. 3, 1985

[30] Foreign Application Priority Data

Apr. 12, 1984 [JP] Japan ..... 59-74420

[51] Int. Cl.[4] ..... G03G 15/00; B65H 39/10

[52] U.S. Cl. ..... 355/14 SH; 271/288; 271/292; 271/297

[58] Field of Search ..... 355/3 SH, 14 SH; 271/287–289, 292, 293, 297, 298, 303, 305

[56] References Cited

U.S. PATENT DOCUMENTS

| | | | |
|---|---|---|---|
| 2,093,992 | 9/1937 | Braam | 271/288 |
| 4,212,457 | 7/1980 | Guenther | 355/14 SH X |
| 4,268,162 | 5/1981 | Ebisawa et al. | 355/3 SH X |
| 4,277,165 | 7/1981 | Wada et al. | 355/3 SH X |
| 4,352,490 | 10/1982 | Hatakeyama | 271/289 |

*Primary Examiner*—Arthur T. Grimley
*Assistant Examiner*—C. Romano
*Attorney, Agent, or Firm*—Jordan B. Bierman

[57] ABSTRACT

In a sorting machine designed for use with a copying machine capable of handling paper of various sizes, a vertical array of sorting bins includes an uppermost sorting bin with an expandable surface area. This allows the sorting machine to handle extraordinarily large paper without increasing the footprint of the sorting machine. The uppermost position ensures that when expanded, the expandable sorting bin will stand over the copying machine, which does not normally need great overhead clearance. The expandable sorting bin may be expandable by virtue of a hinged, sliding or detachable extension plate, and may be expanded automatically when the copying machine detects and signals the use of larger paper. Multiple expandable sorting bins may be used for sorting the extra-large paper. In addition, the sorting machine may have one normal-sized sorting bin in alignment with a main receiving tray of the copying machine so as to allow the main tray to accommodate extra-large paper.

28 Claims, 8 Drawing Figures

SORTING MACHINE AND IMAGE REPRODUCING APPARATUS

BACKGROUND OF THE INVENTION

The present invention relates to a sorting machine and an image reproducing apparatus, such as a electrophotographic copying machine, a telefax machine, a digital processor-associated printer, a printing machine and so forth, which incorporates a sorting machine as optional or standard equipment.

Image reproducing apparatus, such as electrophotographic copying machine and so forth, are useful for reproducing multiple copies of original documents. In such cases, sorting machines are useful for sorting the copies by page or by kind of documents. Japanese Patent First Publication (Tokkai) Sho. 56-78767 discloses a sorting machine associated with a copying machine. The sorting machine includes a plurality of sorting bins and a main tray. A deflecting device of the sorting machine directs reproduced copies to the sorting bins and the main tray one at a time.

In general, the size of the bins and main tray in the sorting machine is chosen to be able to receive the largest recording paper used by the associated image reproducing apparatus, such as an electrophotographic copying machine, a telefax machine, a digital processor-associated printer, a printing machine and so forth, which will be referred to hereafter simply as "copying machine". For instance, when the copying machine is adapted to produce copies on either B5 or A4 size recording paper, the associated sorting machine must have sorting bins and main tray large enough to receive A4 paper. Similarily if the copy machine can copy A3-size sheets, the sorting bins and main tray of the sorting machine must be large enough to receive A3 paper.

In recent years, there has been an increasing demand for copy machines capable of producing expanded copies of original documents, such as design drawings for complicated mechanical devices or electric circuitry. In some cases, the expanded copies may require recording paper of size A2 or greater. In response thereto, copying mechanisms adapted to this need for reproduction of enlarged copies have been developed and become available on the market. However, due to consideration of cost and size, such copying machines capable of producing enlarged copies of, e.g. A2 size are often used in conjunction with sorting machines designed for smaller copies, such as A3. Practically speaking, in conventional sorting machines adapted to receive the large copies, such as A2, the bins and main tray are unacceptably large and take up too much working space.

On the other hand, when the copying machine is not used in conjunction with a sorting machine, a main tray large enough to receive even the largest possible copy can usually be installed at the ejection end of the copying machine with no trouble. However, when a sorting machine is to be installed at the copy ejection end of the copying machine, the working space available to the main tray is strictly limited. As a result, in the latter case, it has been impossible to employ sorting machines which can receive the largest copies. In practice, sorting machines available on the market have been limited to copies of size A3 at a maximum.

SUMMARY OF THE INVENTION

Therefore, it is an object of the invention to provide a sorting machine which remains acceptably compact but is able to handle large copies, such as A2 size.

Another object of the invention is to provide a sorting machine which can simply expand its paper size capacity.

A further object of the invention is to provide an image reproducing apparatus associated with a sorting machine which allows smooth ejection of recording paper, even of the largest size, such as A2.

In order to accomplish the aforementioned and other objects, a sorting machine, according to the present invention, is provided with one or more expandable bins which are normally held in their smaller configuration to receive copies of the same size the remaining bins are designed to receive. The expandable bin or bins are expandable to accommodate larger copies, such as A2 size. The sorting machine also has a deflecting device for distributing smaller or normal-size copies among corresponding bins in order to sort or collate the finished copies. The deflecting device is responsive to the use of large reproducing paper to direct larger copies to the expandable bin or bins.

According to one aspect of the invention, a sorting machine includes at least one of the sorting bins being of expandable surface area so as to accommodate paper larger than the paper of the predetermined size.

According to another aspect of the invention a sorting machine an uppermost sorting bin having an expandable surface area for accommodating sheets of paper larger than the predetermined size, the uppermost bin extending over the image-reproducing apparatus.

According to a further aspect of the invention, a sorting machine includes a plurality of sorting bins. The sorting bins includes a first bin predetermined size, one end of which opposes one end of a document assist tray of the document feeder associated with the image-reproducing apparatus for receiving an original document, aid first pin receving at least part of original documents larger than the predetermined size.

According to a still further aspect of the invention, an image reproducing apparatus comprises a paper eject port formed in the image reproducing apparatus through which recording paper is ejected, a main tray associated with the paper eject port for receiving recording paper of a predtermined size ejected through the paper eject port of the image reproducing apparatus, the sorting machine being associated with the paper eject port parallel to the main tray for receiving ejected recording paper, the sorting machine including a plurality of sorting bins for receiving recording paper of a predetermined size, the sorting bins including at least one expandable bin having an expandable surface area for receiving larger paper than the paper of predetermined size, and means for detecting use of recording paper larger than the predetermned size for introducing recording paper ejected from said paper ejected of the image-reproducing apparatus into the expandable bin.

According to a still further aspect of the invention, an image reproducing apparatus with a sorting machine comprises a paper eject port defined in the image-reproducing apparatus through which paper is ejected, a paper transporting path defined in the sorting machine and associated with the paper eject of the image reproducing apparatus for receiving and transporting paper, a plurality of first bins arranged along the paper transporting path and selectably receiving paper of a first size, a second pin arranged along the paper transporting bin and cooperative with the first bins, the second bin having a surface area varialbe between the first size and a second size, first guide means, associated with each of the first bins, for selectively introducing paper to the first bins, a second guide means, associated with the second bin for guiding paper into the second bin, a detector means for detecting paper size and producing a paper-size-indicative signal indicative of the detected paper size, and a sorter control means for operating the second bin and the first guide means, the control means being responsive to the paper-size-indicative signal indicative of the second size of paper for actuating the second bin to adjust its surface area to accommodate the second size of paper, and for actuating the first guide means to a position preventing introduction of the paper into the first bins so as to direct the second size of paper into the second bin.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiments but are for explanation and understanding only.

In the drawings.

DESCRIPTION OF THE PREFERRED EMBODIMENT

Figure 1:
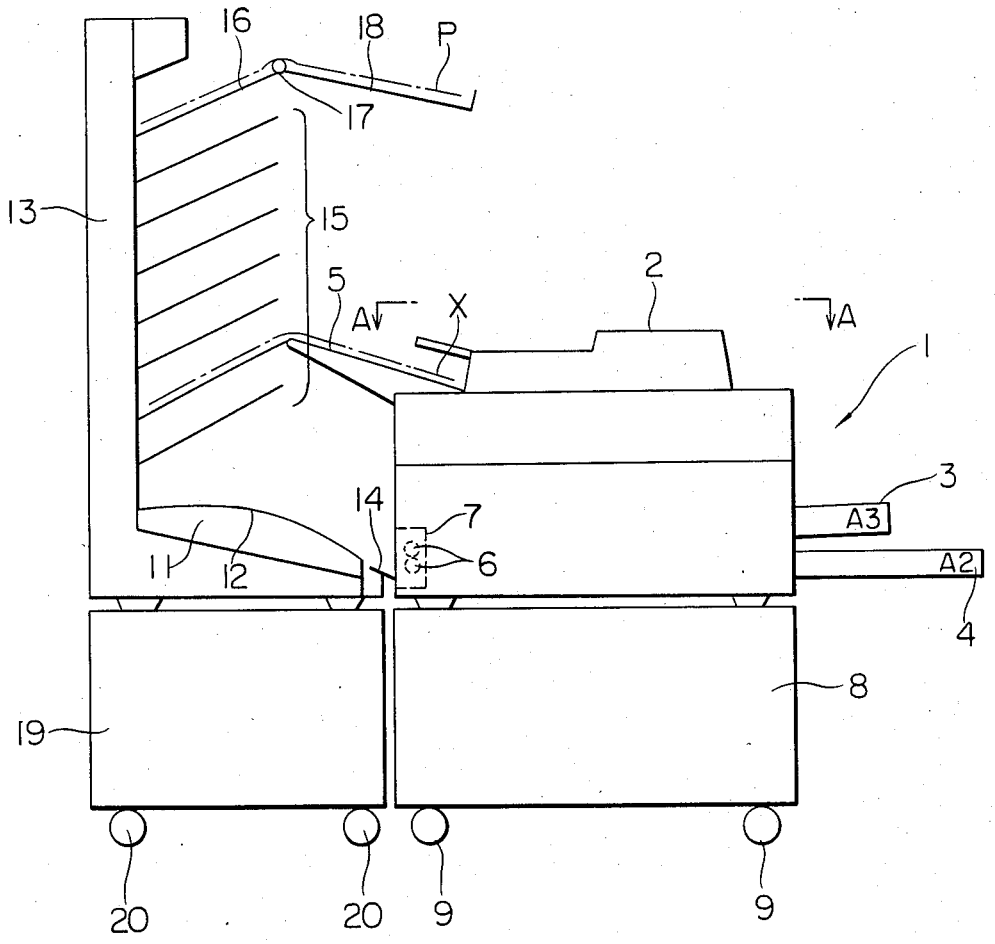
FIG. 1 is a side elevation of an electrophotographic copying machine serving as an image reproducing apparatus with the first embodiment of a sorting machine according to the present invention.

Referring now to the drawings, particularly to FIGS. 1 to 6, a sorting machine 10 according to the first embodiment of the present invention is associated with an electrophotographic copying machine 1. The copying machine 1 has an automatic document feeder 2 with a document assist tray 5. The copying machine 1 receives recording paper cassettes 3 and 4 at its paper supply end. In the shown embodiment, the recording paper cassette 3 contains recording paper of A3 size and the recording paper cassette 4 contains recording paper of A2 size. The cassettes 3 and 4 releasably engage the paper supply end opening of the copyig machine in a per se well-known manner.

The copying machine 1 is mounted on a base 8 with casters 9. Likewise, the sorting machine 10 is mounted on a movable base 19 with casters 20. Therefore, the copying machine 1 and the sorting machine 10 can be moved by means of their mobile bases 8 and 19. The sorting machine 10 has a plurality of sorting bins 15. The sorting machine 10 is arranged adjacent the copying machine in such a manner that it lies in the path of recording paper P ejected from the ejection end after a copying process which will be described later with reference to FIG. 3. For instance, a recording paper receiving section 11 and a main tray 12 of the sorting machine 1 may mate with a paper ejection opening 7 delimited by eject rollers 6. Also, one of the sorting bins 15 of the sorting machine 10 mates with the end of the document assist tray 5 to form a receptacle for large original documents.

Figure 4:
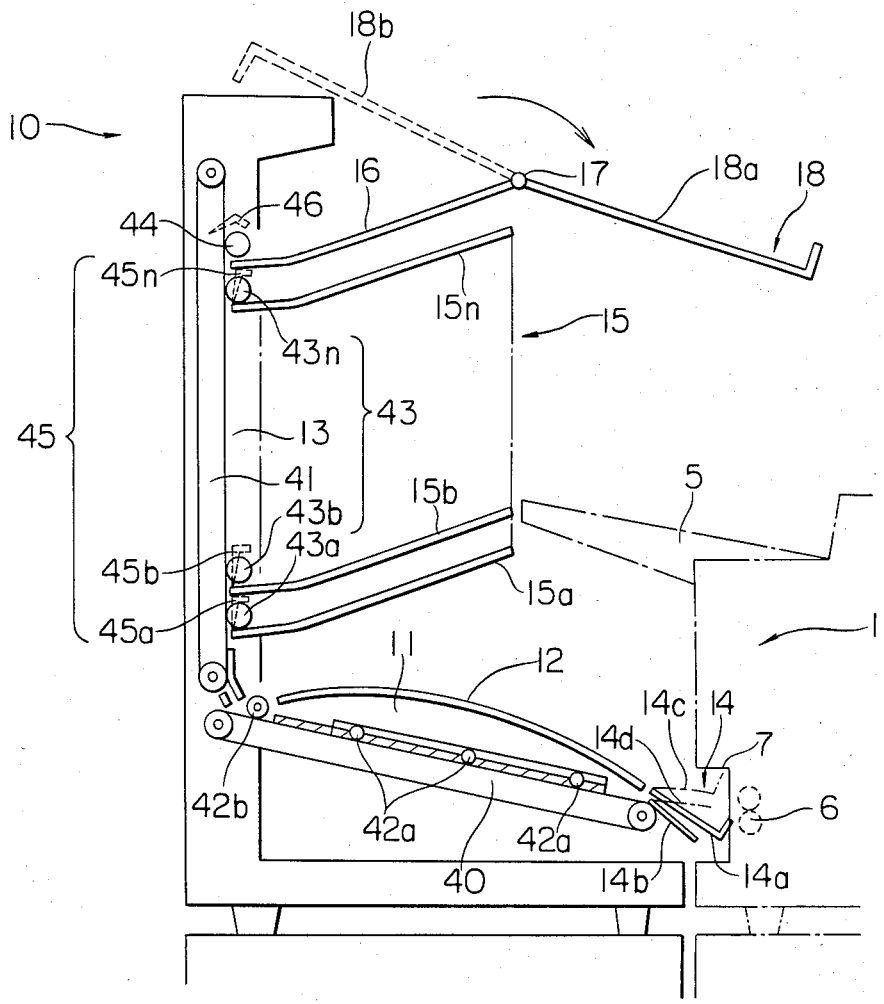
FIG. 4 is an enlarged size elevation of the first embodiment of the sorting machine of the present invention, of FIG. 1.

The recording paper P ejected from the copying machine is delivered or fed to the main tray 12, sorting bins 15 or an expandable bin 16 by a deflecting device 14 shown in FIG. 4. When the ejected recording paper P is fed to the sorting bins 15 or the expandable bin 16, it passes through the recording paper receiving section 11 and the upward paper conveying path 13.

In the shown embodiment, the expandable bin 16 is located at the uppermost position. An auxiliary plate 18 is hinged to the free end of the bin 16. The auxiliary plate 18 normally rests over the bin 16 to form an uppermost sorting bin of the same size as the other bins. When pivoted so as to expand the recording paper receiving surface as shown in FIG. 1, the auxiliary plate 18 extends over the copying machine 1 to receive the larger recording paper, e.g. A2-size paper.

It should be appreciated that the expandable bin 16 need not be the uppermost bin of the sorting machine 10 but can be located at any desired position. In addition, there need not be a single expandable bin 16 in the sorting machine but two or more expandable bins can be provided in the sorting machine if so desired. Furthermore, although the shown embodiment employs an auxiliary plate 18 hinged to the free end of the expandable bin 16 to allow expansion of the recording paper receptacle, it may be connected in various ways to allow expansion of the paper receptacle space. For example, if desired, the auxiliary plate 18 may be mounted for sliding movement between a retracted position in which the auxiliary plate overlaps the bin 16, and an expanded position in which the auxiliary plate slides out of the bin 16 to expand the recording paper receptacle area.

Figure 2:
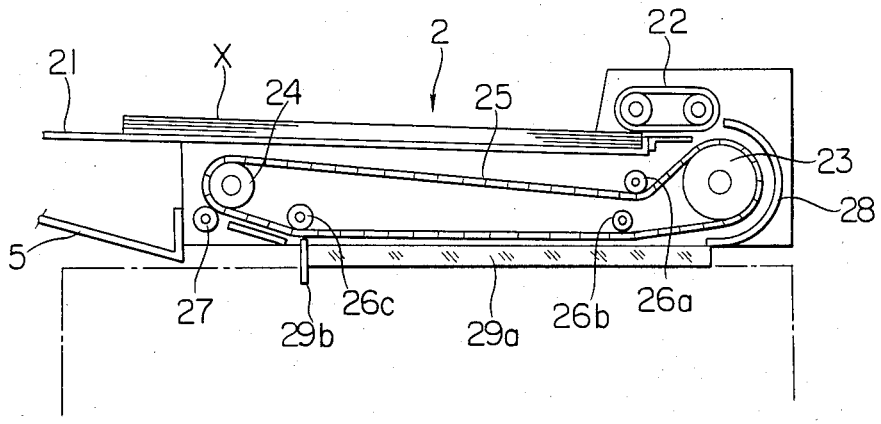
FIG. 2 is a cross-section taken along line A—A of FIG. 1 and showing the structure of an automatic document feeder in the electrophotographic copying machine of FIG. 1.

FIG. 2 shows the automatic document feeder 2 of the copying machine 1 in more detail. The document feeder 2 has an original document tray 21 on which original documents X are to be placed. The original document tray 21 is associated with an endless belt 22 which conveys the uppermost page of the document X toward an endless feeder belt 25. The endless feeder belt 25 in threaded through a driving roller 23, a driven roller 24, guide rollers **26*a*, 26*b* and 26*c*, and a document eject roller 27. A guide plate 28 holds the original document X in contact with the feeder belt 25 as it passes the drive roller 23. A stopper 29*b* is provided at the end of an original glass plate 29*a* opposite the guide roller 26*c*. The original document X is separated from the pile of the original document pages by means of the endless roller 22, conveyed by means of the feeder belt 25 through the path defined by the surfaces of the feeder belt and the guide 28 and the original glass plate 29*a* and then stopped when its leading edge comes into contact the stopper 29b. In this position, an optical system of the copying machine 1 becomes active to perform the scanning exposure of a per se well-known copying process. After performing the scanning operation, the stopper 29b releases the original document X to allow the latter to be ejected by the document feeder belt 25 and the document eject roller 27 into the document assist tray 5. In general, the document assist tray 5 is configured to accommodate A3 size original documents, in the shown embodiment. In practice, it is not possible to expand the size of the document assist tray to receive larger original documents, as the sorting machine 10 stands adjacent to the copying machine. In the shown embodiment, the document assist tray 5 is in contact with the free end of one of the sorting bins 15, thus forming a larger original document receptacle. As a result, larger original documents X can be received in the space defined by the document assist tray 5 and the opposing one of the sorting bins 15. This allows smooth ejection of original documents even larger than the document assist tray 5**.

It should be appreciated that, though the shown embodiment employs direct connection between the document assist tray 5 and one of the sorting bins 15 to expand the document size capacity, it would be possible to leave the opposing ends of the document assist tray 5 and the corresponding sorting bin 15 spaced slightly apart. In this case, a connecting strip may be provided between the opposing ends of the document assist tray and the corresponding sorting bin.

Figure 3:
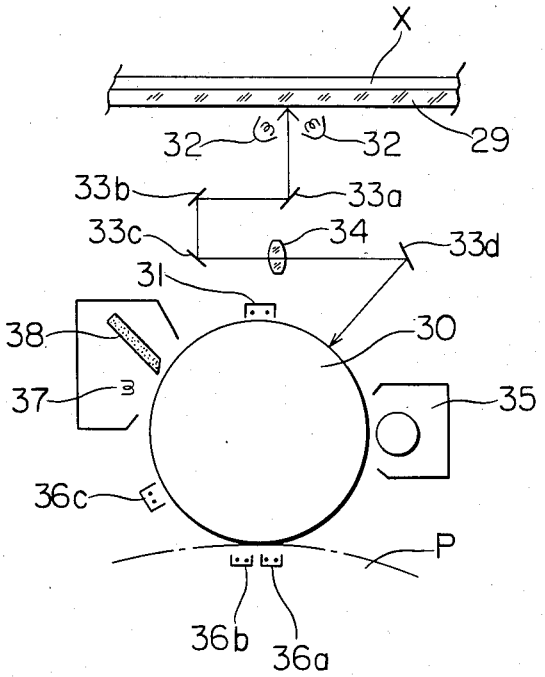
FIG. 3 is a diagram of the process of forming an image on recording paper performed by the electrophotographic copying machine of FIG. 1.

FIG. 3 shows the optical system employed in the copying machine 1. The original document X on the original glass plate 29a is scanned by the optical system of FIG. 3. A photoreceptor drum 30 is uniformly charged by a charging electrode 31 to a uniform electrostatic charge. An image of the original document is formed as a latent electrostiatic image on the photoreceptor drum 30 by means of a lamp 32, reflector mirrors 33a, 33b, 33c and 33d and a lens 34. The latent image on the photoreceptor drum 30 is fixed by a developer 35 to form a toner image. A image transfer electrode 36a transfers the toner image on the photoreceptor drum 30 onto the recording paper P. A separation electrode 36b next to the image transfer electrode 36a separates the recording paper P from the photoreceptor drum 30. The recording paper P onto which the toner image has been transferred next passes through a fusing device which fixes the transferred image. After this, the recording paper P passes through the ejection end opening 7 of the copying machine to the sorting machine 10.

A decharging electrode 36c, a cleaning lamp 37 and a cleaning blade 38 opposing the photoreceptor drum 30 clean or sweep the photoreceptor drum 30 free of any remaining toner.

FIG. 4 shows a conveying or transferring mechanism of the sorting machine 10 for delivering finished copies ejected by the copying machine 1 to the main tray 12 or an appropriate sortiong bin 15 or the expandable bin 16. The sorting machine 10 has a deflecting device 14 near the paper ejection end opening 7 of the copying machine 1, which deflecting device 14 selectively delivers the ejected paper to the main tray 12 or the sorting bins 15 or 16. The deflecting device 14 is associated with a controller, which will be described later, and responds to a mode selector signal and/or paper size detector signal to switch delivery positions.

The structure and operation of the deflector device has been disclosed in detail in the U.S. Pat. No. 4,352,490, issued on Oct. 5, 1982, to Noboru Hatakeyama and assigned to the assignee of this invention. The contents of U.S. Pat. No. 4,352,490 are hereby incorporated by reference for the sake of disclosure.

The deflector device 14 comprises an upper and a lower plate 14a and 14b forming a recording paper guide. In the position of the deflector device 14 shown in solid line in FIG. 4, the upper surface of the upper plate 14a is in alignment with the upper surface of the main tray 12 in order to deliver ejected paper to the main tray. On the other hand, when the deflecting device 14 is shifted to the position shown in phantom line 14c and 14d in FIG. 4, opening between the upper and lower plates 14a and 14b opposes the ejection end opening 7 of the copying machine 1. In this position, the upper surface of the lower plate 14b is in alignment with the upper surface of an endless transport belt 40. Therefore, when the deflecting device 14 is positioned as shown in phantom line in FIG. 4, the ejected paper is delivered to one of the sorting bins 15 or to the expandable bin 16.

The transport belt 40 is stretched between a driving roller and a driven roller and its upper transporting surface is in contact with a plurality of driven rollers 42a. A paper feeder roller 42b is disposed near the distal end of the transport belt 40. The paper feeder roller 42b is associated with a guide mchanism to help feed the paper to a vertical distribution mechanism 45. The paper distribution mechanism 45 defines an upward paper transportation path 13. Also, the paper distribution mechanism 45 employs and endless belt 41 associated with a plurality of paper clamping rollers 43a, 43b, 43c . . . 43n which are generally denoted by the reference numeral "43", and 44. Gate members 45a, 45b . . . in the upward paper transporting path 13 of the sorting machine 10 are each provided for a corresponding sorting bin 15a, 15b . . . 15n, whereas the expandable bin 16 is provided with a normally open gate member 46. The gate members 45 are movable between an open position guiding the transported paper into the corresponding sorting bin 15, and a closed position blocking entry of the transported paper into the corresponding sorting bins 15. These gate members 45 are held closed when using large recording paper e.g. A2. In this case, however, the normally open gate member 46 allows entry of the transported paper into the expandable bin 16.

In order to accommodate large paper, the expandable bin 16 shifts the auxiliary plate 18 to the position illustrated in solid line in FIG. 4. The auxiliary plate 18 is pivotable about a hinge 17, as shown in FIG. 4. The auxiliary place 18 in the expanded position is represented by the reference numeral 18a, and in the retracted position illustrated in broken line in FIG. 4, is represented by the reference numeral 18b. The auxiliary plate 18 in the expanded position 18a enhances the area of the bin 16 in order to accommodate large sheets of paper. In cases where the original document is also large, e.g. A2, it can be ejected into the document assist tray 5 and the sorting bin 15b which mates with the end of the document assist tray at its free end in order to maximize the area of the document assist tray. As will be appreciated herefrom, the first embodiment of the sorting machine according to the invention is able to accommodate large paper.

Figure 5:
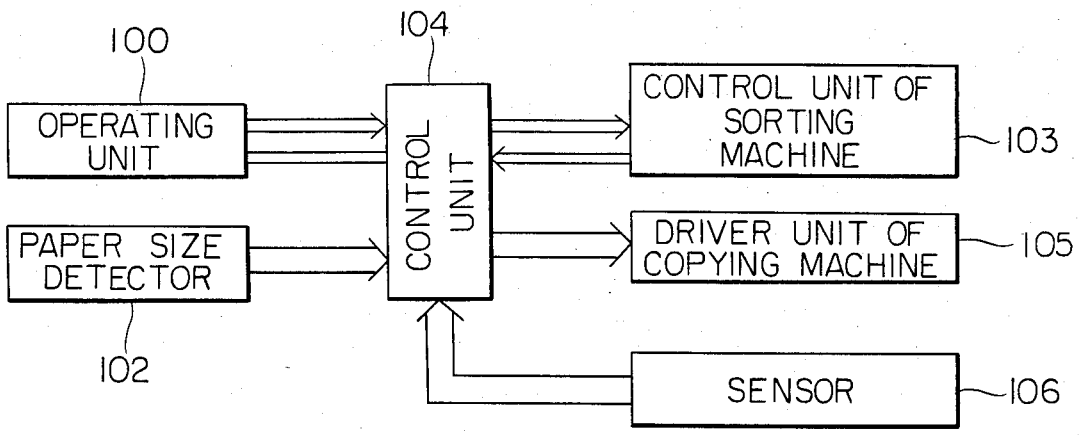
FIG. 5 is a schematic block diagram of a controller associated with the first embodiment of the sorting machine of FIG. 4.

FIG. 5 shows a controller controlling operation of the foregoing sorting machine. As is well known, the copying machine 1 is provided with an operating unit 100 allowing selection of the number of copies, which of the upper and lower cassettes recording paper will be supplied from, sorter operation mode and so forth. The operating unit 100 incorporates indicators for indicating the current operating conditions of the copy machine. In addition, a paper size detector 102 disposed near the cassette receiving opening of the copying machine 1 detect the size of the cassette inserted in the cassette receiving opening of the copying machine and produces a paper size indicative signal. In practice, this can be done by applying a magnet to cassettes containing large paper and by providing a reed switch sensitive to the magnet. The reed switch turns ON when the large-paper cassette is inserted into the copying machine to supply the large paper.

The operating unit 100 and the paper size detector 102 are connected to a control unit 104 which may comprise a microprocessor including CPU and memories. The control unit 104 feeds the signal to the driver unit of copying machine 105 responsive to operation of a copy-start button in the operating unit 100 in order to initiate well-known copying processes according to the copying conditions selected via the operating unit 100. The control unit of sorting machine 103 also controls operation of the sorting machine (sorter) 10 according to the signal from the control unit 104. If sorter operation is selected via the operating unit 100, the control unit 104 actuates the deflecting device 14 to the position shown in phantom line in FIG. 4 so as to guide the recording paper ejected from the paper eject opening 7 of the copying machine to the corresponding sorting bin 15 or 16. The control unit 104 also generates drive signals for driving the transporting endless belts 40 and 41, rollers 43 and 44. The control unit 104 also controls the positions of the gate members 45*a*, 45*b* . . . 45*n* so as to distribute finished copies among the sorting bins 15 or 16.

The control unit 104 is also connected for input from various sensors, such as a paper-jamming detector, a front door switch and so forth. Such sensors will be generally referred to as "sensor 106".

Sorting machine control by the control unit 104 will be described with reference to the flowchart of FIG. 6. It is assumed that A3 and A2 paper cassettes 3 and 4 have been inserted in the copying machine 1. When A3 paper is selected for use by means of the operating unit 100, the auxiliary plate 18 is held in the position 18*b* of FIG. 4. In this position, the normal, well-known paper sorting operation is carried out under the control of the control unit 104. Alternatively, when the A2 paper is selected for use, the auxiliary plate 18 is actuated to the expanded position 18*a* of FIG. 4. At the same time, all of the gate members 45 are closed and the deflecting device 14 is moved to the position shown in phantom line in FIG. 4. Therefore, the recording paper ejected from the copying machine 1 is fed to the uppermost expandable bin 16, the surface area of which is expanded by positioning the auxiliary plate 18 in the expanded position.

Figure 6:
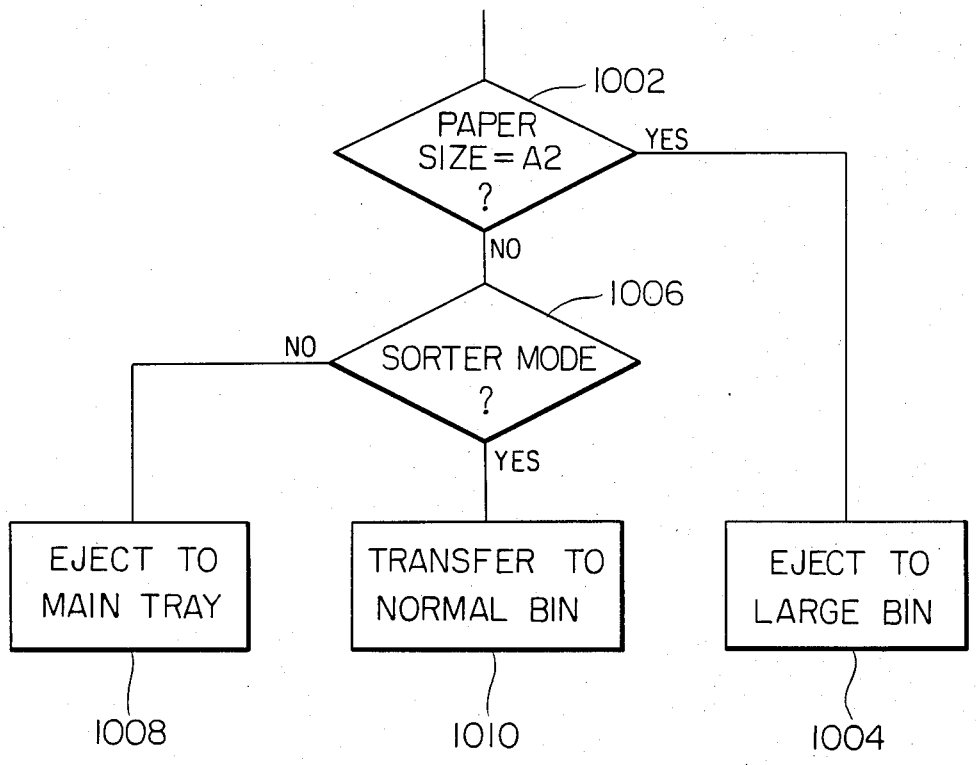
FIG. 6 is a flowchart of operation of the sorting machine of FIG. 4.

As shown in FIG. 6, the control unit 104 first checks the paper size indicative signal from the paper size detector, at a block 1002. If the paper size indicative signal is HIGH, indicating large paper is being used, the control unit 104 outputs a control signal to the control unit of the sorting machine 104 to accept large copies and pass them to the expanded bin 16 at a block 1004. Conversely, when the paper size indicative signal from the paper size detector 102 is LOW when checked at the block 1002, indicating normal-sized paper, the sorter mode selector signal from the operating unit 100 is checked at a block 1006 to see if the sorter mode has been selected or not. If the sorter mode has not been selected, the control unit 104 outputs a control signal ordering the deflecting device 14 to the position illustrated in solid line in FIG. 4 so as to guide the ejected paper into the main tray 12, at a block 1008. Conversely, if the sorter mode has been selected and thus the sorter mode selector signal is HIGH when checked at the block 1006, then control passes to a block 1010 in order to initiate the conventional sorting operation. In this case, the control unit 104 outputs the control signal ordering the sorting machine to normal sorting mode.

It will be appreciate that the auxiliary plate 18 is pivotably connected to the expandable upper bin 16 by means of a conventional hinge means. The hinge mechanism may cooperate with a bias means for resiliently biasing the auxiliary plate toward the position of 18*b* in FIG. 4. An electrically operable actuator is connected to the auxiliary plate 18 and/or the hinge means for actuating the auxiliary plate 18 to the position 18*a* in FIG. 4, when energized by the control signal produced at the block 1004. In addition, a driving system for the deflecting device 14 has been disclosed in the foregoing U.S. Pat. No. 4,352,490. The contents of this U.S. Patent have been incorporated by reference for the sake of disclosure.

Figure 7:
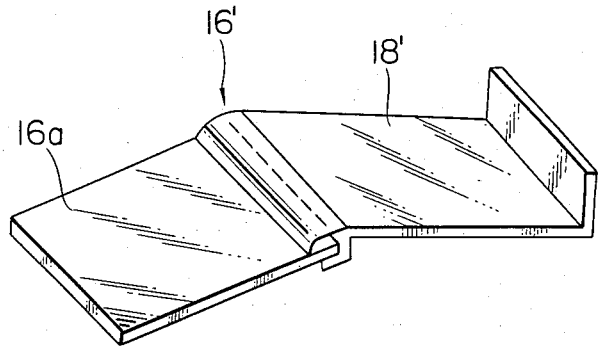
FIG. 7 is a perspective view of an expandable bin in the second embodiment of the sorting machine according to the present invention.

FIG. 7 shows an expandable bin 16' employed in the second embodiment of the sorting machine according to the present invention. The second embodiment of the sorting machine is specially adapted for use with a copy machine of the type having a stationary optical system and movable original table. This type of copying machine has been disclosed in the U.S. Pat. No. 4,361,397, issued on Nov. 30, 1982, to Katakura et al, for example. As in the foregoing first embodiment, the copy machine to which the second embodiment of the sorting machine is applied with accept two or more paper cassettes of various size. The copy machine may accept a cassette containing large recording paper, such as A2 size paper. Furthermore, the shown second embodiment includes two or more expandable bins into which the large recording paper may be ejected from the copy machine. Each of the expandable bin 16' comprises a major section 16*a* of the same general size as the other normal-sized sorting bins. An attachment plate 18' has means for releasably engaging the free end of the major section 16*a*, as shown in FIG. 7. This attachment plate 18' may be regarded as a replacement for the hinged auxiliary plate 18 of the first embodiment.

The attachment plate 18' may normally be removed from the major section 16*a* of the expandable bin 16' and stored in appropriate storage near the sorting machine. When large copies are to be reproduced, the attachment plate 18' is fitted onto the free end of the major section 16*a* by resilient engagement between their opposing ends.

For the type of the copy machine set forth above, since the movable original table carries the original document the document assist tray is not required.

Figure 8:
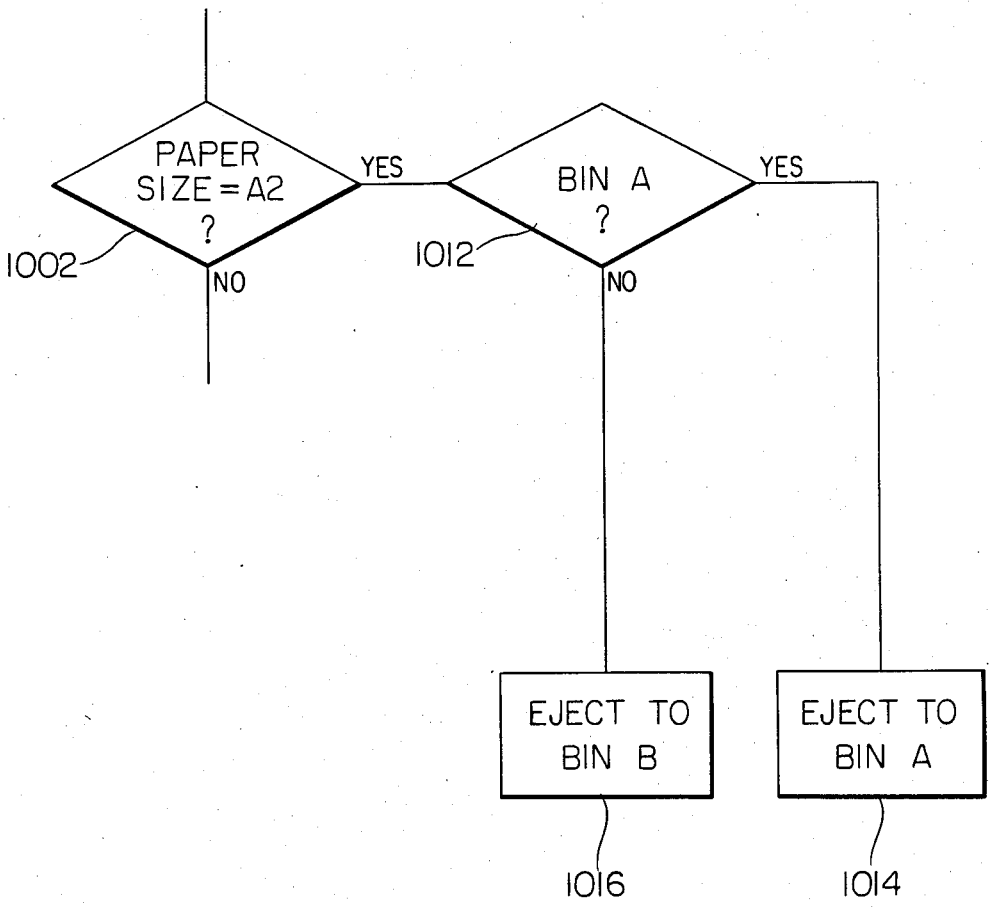
FIG. 8 is a flowchart of operation of the second embodiment of the sorting machine of the invention.

FIG. 8 shows a flowchart of the control process for the second embodiment of sorting machine including selection of the proper expandable bin 16' into which to eject the copy. In this flowchart, blocks 1012, 1014 and 1016 are to be executed after a positive response to the block 1002 of the flowchart of FIG. 6. That is, this expandable bin selection routine is executed when the large copies are selected at the block 1002.

In the block 1012, the input from a bin selector in the input unit is checked. The bin selector is designed to allow designation of one of the expandable bins, which will be referred to hereafter as "bin A" and "bin B" for convenience. Furthermore, it is assumed that a HIGH-level input from the bin selector represents designation of the bin B and a LOW-level input from the input unit represents designation of the bin A. If the input level from the bin selector is LOW when checked at the block 1012, the central controller outputs a control signal for controlling the position of the gate members 46 of expandable bins 16 so as to actuate the gate member of the bin B to its closed position and the gate member of the bin A to its open position in order to divert the finished copy into the bin A, at the block 1014. Conversely, when the input level is HIGH, the gate member of the bin A is moved to its closed position and the gate member of the bin B is opened at the block 1016.

In this case, the gate members corresponding to the bins A and B may be operated in substantially the same manner as the gate members of the normal sorting bins. The structure and operation of the gate member operating means are discussed in the aforementioned U.S. Pat. No. 4,352,490, for example.

According to the invention, by providing bin or bins capable of expanding to accommodate large paper either manually or automatically with the aid of a paper size sensor, the sorting machine can be held to an acceptably compact size while being adapted for use with larger paper. This may eliminate the need for different copying machines for copying documents of different size as was sometimes necessary in the prior art.

While the present invention has been disclosed in terms of the specific embodiments of the invention. The invention should be appreciated as including all possible embodiments and modifications of the shown embodiment which do not departing from the principle of the invention set out in the appended claims.

What is claimed is:

1. A sorting machine for collating sheets ejected from an image-reproducing apparatus comprising a plurality of sorting bins comprising at least one large bin and at least one small bin;

a conveying means for transporting the sheets to the bins;

a guide means for selectively leading the sheets being transported by the conveying means into the bins;

a control means for controlling the guide means to lead a large sheet which is incapable of being received in the small bin to the large bin in response to a signal generated by a means mounted in the image-reproducing machine for detecting a selection of the large sheet.

2. The sorting machine of claim 1, wherein the large bin is adjustable to a smaller size.

3. The sorting machine of claim 1, wherein the large bin is only one.

4. The sorting machine of claim 3, wherein the large bin is the uppermost of a vertical array of the bins.

5. The sorting machine of claim 2, wherein the large bin has a pivotably attached plate.

6. The sorting machine of claim 2, wherein the large bin comprises a major portion and an attachment plate, said attachment plate being in engagement with the major portion.

7. The sorting machine of claim 1, wherein the large bin extends over the image-reproducing machine.

8. An image-reproducing apparatus with a sorting machine comprising:

a paper eject port formed in said image reproducing apparatus through which recording papers of a predetermined size or large size are ejected;

a main tray associated with said paper eject port for receiving said recording papers ejected through said paper eject port of said image reproducing apparatus;

said sorting machine being associated with said paper eject port for receiving ejected recording papers, comprising a plurality of sorting bins having at least one large bin and at least one small bin; means for detecting use of the large size paper and generating a signal in response to the detection;

guide means for selectively leading the recording papers into the sorting bins; and control means for controlling the guide means to lead the large size paper to the large bin in response to the signal.

9. The image reproducing apparatus of claim 8, wherein said means for detecting includes a sensor adapted to detect said large size recording paper.

10. An image-reproducing apparatus with a sorting machine comprising:

a paper eject port defined in said image-reproducing apparatus through which paper is ejected;

a paper transporting path defined in said sorting machine and associated with said paper eject part of said image reproducing apparatus for receiving and transporting paper;

at least one first size bin arranged along said paper transporting path, the at least one first size bin being capable of receiving papers being equal to or smaller than a first size;

at least one second size bin arranged along said paper transporting path and cooperative with said at least one first bin, said at least one second size bin being larger than the at least one first size bin and capable of receiving papers which are a second size which is larger than the first size;

first guide means, associated with said at least one first size bin, for selectively introducing papers to said at least one first size bin;

second guide means, associated with said at least one second size bin for guiding papers into said at least one second size bin; and a detector means for detecting paper size and producing a paper-size-indicating signal indicating the second size paper; and a sorter control means for operating said second and first guide means, said sorter control means being responsive to said paper-size-indicating signal indicating said second size paper for actuating said first guide means to a position preventing introduction of said second size paper into said at least one first size bin and actuating said second guide means to a position leading said second size paper into said at least one second size bin.

11. The image-reproducing apparatus of claim 10, which further comprises a main tray associated with said paper eject port, and third guide means associated with said paper eject port for selectively introducing said paper ejected from said paper eject port into said main tray or to said paper transporting path of said sorting machine.

12. The image-reproducing apparatus of claim 11, wherein said sorter control means includes an operating unit being responsive to a selection of either a sorting mode or a non-sorting mode, said sorter control means actuating said third guide means to a first position in which said third guide means introduces ejected paper into said main tray when said non-sorting mode is selected, and to a second position in which said third guide means introduces said ejected paper into said paper transporting path when the sorting mode is selected, said sorter control means being responsive to said paper-size-indicating signal indicating said second size paper to operate said third guide means to said second position irrespective of the selection.

13. The image-reproducing apparatus of claim 12, which further comprises a document assist tray of a document feeder for receiving original documents, said document assist tray having a surface area sufficient to accommodate said original documents, being substantially equal to the first size paper and cooperating with said at least one first size bin for accommodating said original document which is substantially equal to the second size paper.

14. The image-reproducing apparatus of claim 13 wherein one end of said document assist tray opposes one end of a cooperating at least one first size bin to form a second-size receptacle.

15. The image-reproducing apparatus of claim 10, wherein the at least one second size bin has a surface area variable between the first size paper and the second size paper.

16. The image-reproducing apparatus of claim 15, wherein the sorter control means is responsive to the paper-size-indicating signal indicating the second size paper for actuating the at least one second size bin to adjust its surface area to accommodate the second size paper.

17. An image-reproducing apparatus with a sorting machine and a document feeder wherein the sorting machine comprises a plurality of sorting bins having at least one large bin and at least one small bin, a conveying means for transferring sheets to the sorting bins, a guide means for selectively leading the sheets being transferred by the conveying means into the sorting bins, and a control means for controlling the guide means to lead a large sheet which is incapable of being received in the at least one small bin to the at least one large bin in response to a signal generated by a means mounted in the image-reproducing machine for detecting a selection of the large sheet, wherein said document feeder comprises a document assist tray extending toward the sorting machine, a document receiving tray for cooperatively receiving a part of a large document extending from the document assist tray, said document receiving tray being one of the small bins and positioned close to the document assist tray.

18. The image-reproducing machine of claim 17, wherein said at least one small bin engages said document assist tray at its opposing end.

19. The image-reproducing machine of claim 17, further comprising a connecting strip interposed between opposing ends of said at least one small bin and said document assist tray for forming an expanded paper receptacle.

20. An image-reproducing apparatus with a sorting machine comprising:

a paper eject port defined in said imagereproducing apparatus through which paper is ejected;

a paper transporting path defined in said sorting machine and associated with said paper eject port of said image reproducing apparatus for receiving and transporting paper;

a plurality of first bins having a surface area of a first size, said plurality of first bins being arranged along said paper transporting path and selectively receiving paper of a first size;

a second bin arranged along said paper transporting path and cooperating with said first bins, said second bin having a surface area variable between said first size and a second size for selectively receiving paper of a second size;

a first guide means, associated with each of said first bins, for selectively introducing paper to said first bins;

a second guide means, associated with said second bin for guiding paper into said second bin;

a detector means for detecting paper size and producing a paper-size indicating signal indicating the second size paper; and a sorter control means for operating said second bin and said first guide means, said sorter control means being responsive to said paper-size-indicating signal indicating said second size paper for actuating said second bin to adjust its surface area to accommodate said second size paper, and for actuating said first guide means to a position preventing introduction of said second size paper into said first bins so as to direct said second size paper into said second bin.

21. The image-reproducing apparatus as set forth in claim 20, which further comprises a main tray associated with said paper eject port, and movable paper guide means associated with said paper eject port for selectively introducing said paper ejected from said paper eject port into either the main tray or the paper transporting path of said sorting machine.

22. The image-reproducing apparatus as set forth in claim 21, wherein said sorter control means includes an operating unit which allows a selection of either a sorting mode or a non-sorting mode, said sorter control means actuating said movable paper guide means to a first position in which said movable paper guide means introduces ejected paper into said main tray when said non-sorting mode is selected, and to a second position in which said paper guide means introduces said ejected paper into said paper transporting path when the sorting mode is selected, said sorter control means being responsive to said paper-size-indicating signal indicating said second size paper to move said paper guide means to said second position irrespective of which of the sorting or non-sorting modes has been selected.

23. The image-reproducing apparatus as set forth in claim 22, wherein said second size paper is larger than said first size paper.

24. The image-reproducing apparatus as set forth in claim 23, which further comprises a document assist tray for receiving original documents, said document assist tray having a surface area sufficient to accommodate a first size original document which is equal to said paper of a first size and cooperating with one of said first bins for accommodating a second size original document which is equal to said paper of a second size.

25. The image-reproducing apparatus as set forth in claim 24, wherein one end of said document assist tray opposes one end of a cooperating first bin to form a second size paper receptacle.

26. The image-reproducing apparatus as set forth in claim 23, wherein said sorting machine further comprises a plurality of second bins among which said second size paper may be distributed.

27. The image-reproducing apparatus as set forth in claim 26, wherein said operating unit includes a bin selector for selecting into which of said second bins said paper of said second size is to be introduced, and said sorter control means is responsive to a command from said bin selector for actuating said second guide means for introducing said paper into the selected one of said second bins.

28. The image reproducing apparatus as set forth in claim 27, wherein said sorter control means is responsive to said paper-size-indicating signal indicating said second size paper for actuating said second guide means in accordance with said command from said bin selector.

* * * * *